United States Patent [19]

Byrne

[11] 3,959,934

[45] June 1, 1976

[54] COMPOSITION AND METHOD FOR REPAIRING SELENIUM PHOTORECEPTORS

[75] Inventor: John Frank Byrne, Worthington, Ohio

[73] Assignee: Xerox Corporation, Stamford, Conn.

[22] Filed: Oct. 4, 1974

[21] Appl. No.: 512,804

[52] U.S. Cl. ..... 51/317; 51/283; 51/306; 51/308

[51] Int. Cl.[2] ..... B24B 1/00

[58] Field of Search ..... 51/306, 308, 307, 309, 51/283, 317

[56] References Cited

UNITED STATES PATENTS

| | | | |
|---|---|---|---|
| 2,006,162 | 6/1935 | Fuchs | 51/304 |
| 2,297,691 | 10/1942 | Carlson | 51/308 |
| 2,654,194 | 10/1953 | Raab | 51/306 |
| 2,944,879 | 7/1960 | Allen et al. | 51/304 |
| 3,650,956 | 3/1972 | Strand et al. | 51/308 |

*Primary Examiner*—Donald J. Arnold

[57] ABSTRACT

Disclosed is a composition and method for repairing a damaged electrostatographic photoreceptor comprised of a conductive substrate with a uniform layer of selenium or a selenium alloy on its surface. Scratches in the selenium layer of a depth less than its total thickness are polished with the instant composition whereby the affected surface area is buffed to a smooth finish. After application of the polish composition, the electrostatic effects of the original scratch are eliminated and the repaired photoreceptor will provide copies in which printout in the repaired areas is of the same quality as in the non-damaged areas.

8 Claims, No Drawings

COMPOSITION AND METHOD FOR REPAIRING SELENIUM PHOTORECEPTORS

BACKGROUND OF THE INVENTION

The process of electrostatographic copying, as originally disclosed by C. F. Carlson in U.S. Pat. No. 2,297,691, involves the uniform electrostatic charging of a layer of photoconductive material dispersed on a conductive substrate with subsequent exposure of the charged layer to light and shadow to selectively discharge the photoconductive layer and thereby form a latent electrostatic image on the surface of the layer corresponding to the shadow areas. The latent image is developed by contacting the layer with a particulate electroscopic marking material, commonly referred to as toner, which adheres to the non-discharged areas and can be transferred to a receiving member such as paper in imagewise configuration.

The conductive substrate and layer of photoconductive material, which normally contains a resistive barrier layer between the substrate and photoconductive material and may have a protective overcoating on the surface of the photoconductive layer, is generally referred to as the photoreceptor. Typically, the photoconductive material used in photoreceptors is amorphous selenium or an alloy thereof. As is well known, amorphous selenium and selenium alloy photoreceptors are sensitive materials, being easily scratched or electrically affected by foreign objects or human hand contact.

Photoreceptors are easily damaged in field use such as by paper scratching and handling damage which may occur when the photoreceptor is installed or serviced. In addition, foreign matter such as paper clips may come into contact with the photoreceptor during the copying process and gouge the layer of photoconductive material. The damaged photoreceptor is left with depressions on its surface which reduce copy quality. In the case where the depression is deep enough so as to protrude through the photoconductive material to the conductive substrate, the damaged area cannot hold a charge and will not contribute to the formation of the latent image. Less severe scratches which do not form depressions through the entire thickness of the photoconductive layer may be revealed on the finished copy. Copy quality can be reduced initially since the photoconductive material remaining in the damaged area may have a contrast potential less than the sensitivity of the system. In addition, as the imaging and development cycle is repeated, toner particles tend to build up in the depressions since ordinary photoreceptor cleaning techniques are effective in removing toner only when it is on a relatively smooth surface. The buildup of toner particles, which are normally non-conductive, results in damaged areas retaining their charge during exposure and thereby forming part of the latent image. These areas are developed along with the rest of the latent image and ultimately show up as dark areas when the toner is transferred from the photoreceptor to the paper.

As the photoreceptor receives progressively more scratches, it reaches a point where copy quality is unacceptable whereupon it must be replaced or repaired with the latter option obviously being preferred. One method of repairing selenium based photoreceptors involves buffing the damaged areas to physically remove the depression by abrading away the photoconductive material in the scratched area down to a thickness commensurate with the total layer thickness less the depth of the depression. While various polishes and buffing agents have been utilized in selenium repair they have been found unsatisfactory for many reasons. Some are too abrasive resulting in damage to the affected area of application. Others contain constitutents which leave a film on the selenium photoreceptor surface resulting in an electrostatically occluded area. Additionally, some buffing compositions require more than ordinary technique and care thereby rendering them unsatisfactory for field application, i.e., in offices and any other places where copiers are placed.

Accordingly, it would be desirable and it is an object of the present invention to provide a composition and a novel method for the repair of photoreceptors which overcomes the aforementioned prior art disadvantages.

A further object is to provide such a composition and method which is readily adaptable for field use.

An additional object is to provide a composition and a method for repairing damaged selenium photoreceptors which is quick, easy to use and can be practiced without special training and/or equipment.

SUMMARY OF THE INVENTION

The present invention is a method for the repair of an electrostatographic photoreceptor comprised of a conductive substrate with a uniform dispersion of selenium or a selenium alloy on its surface as the photoconductive layer in which the photoreceptor has been damaged by the formation of a scratch, fissure, aggravated surface conductivity, or depression partially through the photoconductive layer. The composition of the instant invention includes a mixture of zinc oxide as a primary suspending agent, a secondary suspending agent, and an abrasive dispersed in an organic liquid medium. The organic liquid medium generally comprises hydrocarbon liquids such as isopropyl alcohol and kerosene based solvents. The method of the instant invention includes: (a) providing a composition comprising a mixture of zinc oxide as a primary suspending agent, a secondary suspending agent and an abrasive dispersed in a solvent; (b) applying the composition to a physically damaged area of a selenium or selenium alloy photoreceptor; and (c) rubbing the composition about the damaged area so as to effect a smoothing of the physically damaged area of the photoreceptor.

DETAILED DESCRIPTION OF THE INVENTION

Typically, the photoreceptors which are repaired by the process of the present invention comprise selenium which has been vapor deposited under vacuum onto an aluminum drum having an insulating barrier layer of aluminum oxide on its surface. In another embodiment, the selenium is deposited on a flexible nickel belt having a resistive polymer coating on its surface as the barrier layer. As used herein, the term selenium is intended to refer to amorphous elemental selenium or an alloy thereof. Examples of selenium alloys useful in photoreceptors are the selenium/arsenic alloy disclosed by Ullrich in U.S. Pat. No. 2,803,542 and the selenium-/arsenic alloys doped with halogen disclosed by Straughan in U.S. Pat. No. 3,312,548.

Commercial photoreceptors of the type which can be repaired by the method of the present invention normally have a layer of selenium or selenium alloy of from 50 to 70$\mu$ in thickness on the conductive substrate. Repair of scratches in the selenium surface has been problematical due to the difficulty of providing a material which can be applied to the damaged areas which has discharge characteristics similar to the selenium. As used herein, discharge characteristics is a term intended to refer to various characteristics of a photoconductive material such as spectral response, quantum efficiency, dark decay and dark dielectric constant. Alternatively, polishes or rubbing composition have proven unsatisfactory for reasons already given above.

The composition of the present invention includes zinc oxide as the primary suspending agent, an abrasive such as feldspar C-6, and a secondary suspending agent such as Santocel Z dispersed in a suitable hydrocarbon liquid medium. The organic liquid medium for the present composition generally includes a mixture of isopropyl alcohol and a kerosene based solvent such as Sohio 3440 solvent. It is to be noted that any functional organic liquid medium will suffice within the purview of the present invention. Generally, the composition should comprise sufficient zinc oxide to ensure the complete suspension of the abrasive. The amount of abrasive is dependent upon the degree of solidification of the paste which one desires. The solvent for the composition generally can go as high as up to four-fifths of a kerosene based solvent and one-fifth isopropyl alcohol by weight.

Within the purview of the present composition any abrasive may be used in combination with the zinc oxide primary suspending agent. Suitable abrasives include feldspar (aluminum sodium (or potassium) silicate) products containing feldspar such as Bon Ami detergent supplied by Faultless Starch Company, and aluminum oxide supplied by Union Carbide. A preferred abrasive is feldspar C-6, or feldspar G-200, supplied by the Feldspar Corporation.

Suitable secondary suspending agents for the present composition include Santocel Z (silica aerogels) supplied by Monsanto Corporation of St. Louis, Mo. Other suitable secondary suspending agents include Cabosil (colloidal silica particles) supplied by the Cabot Corporation.

While kerosene based solvents and isopropyl alcohol are used as a preferred solvent mixture for the present composition, any hydrocarbon liquid may be used as the suspension medium.

A preferred technique for utilizing the instant composition to repair a damaged selenium photoreceptor is simply to apply it on the damaged selenium photoreceptor is simply to apply it on the damaged area with a soft gauze cloth. Sufficient material is applied to cover the area of the depression or scratch so that upon subsequent rubbing or buffing a smooth surface containing no bumps or depressions is provided. Subsequent to rubbing any excess material should be removed to avoid any residual accumulation of the polish and thereby provide a substantially smooth surface. After application and removal of the polish the photoreceptor can be ventured to service.

A person skilled in the art who seeks to repair a given selenium photoreceptor having damage in the form of depressions, scratches, or cracks in its surface of a given depth will realize that he must apply the instant composition for a time period commensurate with the damage.

This and other aspects of the present invention are further illustrated by the following examples in which all parts are by weight unless otherwise specified.

EXAMPLE I

An electrostatographic photoreceptor consisting of an aluminum cylinder, 8" in diameter and 12" long, with a uniform 60$\mu$ layer on its surface of a phtoconductive selenium alloy containing 0.33% As and 20 ppm chlorine, is scratched to a depth of about 20$\mu$. The photoreceptor is used in the normal xerographic mode with unsatisfactory results due to the toner buildup in the depressions created by the scratches with consequent failure to discharge in these areas causing them to appear as black marks on the copies produced. The toner is first removed from the scratches by wiping with a cloth or by use of a cotton swab wetted with isopropyl alcohol.

A polish composition of the instant invention is prepared as follows:

a. place the following materials in a 1-liter wide month polyethylene jar:

320 g feldspar (C-6) supplied by the Feldspar Corporation.

600 mls.Sohio solvent 3440

200 mls. isopropanol 10 g Santocel-Z, supplied by the Monsanto Corporation.

b. shake the material in polyethylene jar for 30 minutes with a "Red Devil" paint mixer.

c. add 20 g zinc oxide available as KADOX 25 supplied by the New Jersey Zinc Co.

d. shake an additional 2 minutes with the paint shaker to completely agitate the composition. Thereafter, the composition is in the form of a paste.

The paste is then applied to the 20$\mu$ scratch on the photoreceptor referred to above by means of a gauze cloth, a soft sponge, or alternatively, a cotton pad. The damaged area is rubbed vigorously, with further liberal application of paste, with continual scrutiny of the damaged area. When the crack appears relativly smoothed, the buffing is terminated and the residual polish, contaminated with particles of the selenium alloy, removed. The damaged area of the photoreceptor demonstrates a smooth scar in place of the original scratch.

The repaired photoreceptor is employed to produce copies in the normal xerographic mode. Inspection of the copies produced discloses that the scratched area which appeared black before repair now are undetectable. The image areas on the copies are uninterrupted since the repaired area has discharge properties substantially equivalent to the undamaged areas of te photoreceptor.

If a feldspar containing agent such as Bon Ami (Faultless Starch Co.) were used as the abrasive then the particle size of the abrasive would have to be reduced by using ceramic shot in the preparation.

EXAMPLE II

An endless nickel belt, 65 inch in diameter, 16½ inch wide and 4.5 mils thick having a polymeric barrier layer on its surface covered with a uniform 60$\mu$ thick layer of a selenium alloy containing 0.33% As and 100 ppm chlorine, is scratched to provide depressions of approximately 5$\mu$ in depth. The damage is repaired in the same manner, using the same composition, as described in Example 1. Copies made in the xerographic mode after repair contain no deletions or dark marks in the scratched areas. This is contrasted with copies made before repair wherein the copy areas corresponding to the scratched portions of the photoreceptor appear as black lines.

Unless otherwise specified all percentages used in the instant application are by weight.

What is claimed is:

1. A composition for repairing damaged selenium photoreceptors comprising:

a. zinc oxide;

b. a secondary suspending agent selected from the group consisting of silica aerogels and colloidal silicas; and c. an abrasive; all three items being suspended in an organic liquid medium selected from the group consisting of liquid hydrocarbons, alcohols and mixtures thereof;

2. The composition of claim 1 wherein the abrasive is feldspar.

3. The composition of claim 1 wherein the liquid medium comprises isopropyl alcohol and a kerosene based liquid in a respective weight ratio of up to 5 to 1.

4. The composition of claim 2 wherein the abrasive and the suspending agents are present in sufficient amounts to form a paste.

5. A method for repairing a damage area on a selenium photoreceptor comprising:

a. providing a polish composition including (i) zinc oxide, (ii) a secondary suspending agent selected from the group consisting of silica aerogels and colloidal silicas and an abrasive, all three materials being suspended in an organic liquid medium selected from the group consisting of liquid hydrocarbons, alcohols and mixtures thereof;

b. applying the polish composition to a physically damaged area of a selenium photoreceptor; and c. rubbing the polish composition about the damaged area so as to effect a smoothing of the physically damaged area of the photoconductor.

6. The method of claim 5 wherein the abrasive is feldspar.

7. The composition of claim 5 wherein the liquid medium comprises isopropyl alcohol and a kerosene based liquid in a respective weight ratio of up to 5 to 1.

8. The composition of claim 5 wherein the abrasive and the suspending agents are present in sufficient amounts to form a paste.

* * * * *